US006474939B1

(12) United States Patent
Bratu

(10) Patent No.: US 6,474,939 B1
(45) Date of Patent: Nov. 5, 2002

(54) CELL FOR PUMPING A MULTIPHASE EFFLUENT AND PUMP COMPRISING AT LEAST ONE OF THE CELLS

(75) Inventor: Christian Bratu, Saint-Nom-la-Breteche (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 0 days.

(21) Appl. No.: 09/622,350

(22) PCT Filed: Feb. 9, 1999

(86) PCT No.: PCT/FR99/00279

§ 371 (c)(1),
(2), (4) Date: Aug. 16, 2000

(87) PCT Pub. No.: WO99/42732

PCT Pub. Date: Aug. 26, 1999

(30) Foreign Application Priority Data

Feb. 18, 1998 (FR) ..... 98 01971

(51) Int. Cl.[7] ..... F04D 31/00

(52) U.S. Cl. ..... 415/74; 415/72; 415/143; 415/199.4; 415/199.5; 416/175; 416/177

(58) Field of Search ..... 415/143, 199.4, 415/199.5, 72, 74; 416/176, 177, 175, 203, 198 R, 200 R, 201 A; 366/264, 266, 307

(56) References Cited

FOREIGN PATENT DOCUMENTS

| | | | | |
|---|---|---|---|---|
| FR | 801772 A | * | 8/1936 | ..... 416/176 |
| JP | 62-237092 A | * | 10/1987 | ..... 415/143 |
| JP | 4-78430 A | * | 3/1992 | ..... 366/307 |

* cited by examiner

*Primary Examiner*—Christopher Verdier
(74) *Attorney, Agent, or Firm*—Antonelli, Terry, Stout & Kraus, LLP

(57) ABSTRACT

A cell for pumping a multiphase effluent includes two rotary parts (4–5), the first one (4) having a hydraulic wheel designed for transmitting kinetic energy to each of the multiphase effluent phases entering cell (1*a*–1*b*), and the second one (5), following the first, being an energy converting device designed for homogenizing the phases, transferring kinetic energy between the phases, entraining the lightest phase, converting kinetic energy into pressure and compressing the homogeneous effluent before it leaves the cell. All of the rotary parts of the cell are mounted on a common shaft (3) axially arranged inside a fixed housing (2) having an inlet and an outlet for the multiphase effluent.

13 Claims, 2 Drawing Sheets

CELL FOR PUMPING A MULTIPHASE EFFLUENT AND PUMP COMPRISING AT LEAST ONE OF THE CELLS

FIELD OF THE INVENTION

The present invention relates to a cell for pumping a multiphase effluent and to a pump comprising such a cell or several of such cells mounted in series. A multiphase effluent is understood to be an effluent consisting of a mixture of at least two phases selected from (a) a liquid phase consisting at least of one liquid, (b) a gas phase consisting at least of a free gas, and (c) a solid phase consisting of particles of at least one solid suspended in (a) and/or (b).

BACKGROUND OF THE INVENTION

Multiphase pumping is a technology used in many industrial sectors, such as petroleum and gas production (pumping of a petroleum two-phase effluent consisting of a mixture of oil and of gas), the chemical industries, the nuclear industry (pumping of a mixture of water and of steam), and spacecrafts.

The base architecture of industrial pumps used for multiphase effluent pumping includes an impeller (or hydraulic wheel) followed by a stator (or static diffuser). The function of the impeller is to transmit kinetic energy to the mixture to be pumped, the static diffuser then performing transfer of the mixture under pressure, in particular to the impeller of the cell located immediately downstream in the case of a pump comprising several pumping cells.

Theoretical studies and tests have shown that there is a relation between the liquid single-phase pumping head ($H_L$) and the multiphase effluent pumping head ($H_{Ph}$):

$$H_{Ph}=E\times H_L$$

where E is the multiphase efficiency, which is essentially a function of the void fraction $\alpha$ and of the pressure at the inlet, $$(\alpha = \frac{Q_G}{Q_G + Q_L},$$

$Q_G$ and $Q_L$ being the pumping speeds of the gas G and of the liquid L respectively).

Application of conventional pumps (centrifugal, axial-flow or semiaxial-flow pumps) to pumping of a mixture of water and steam has been studied in the nuclear field for one-stage pumps (impeller and stator) in order to be able to face up to an exceptional accident in a reactor. The tests that have been carried out on that occasion show that the two-phase pumping efficiency E greatly decreases as soon as the void fraction a exceeds 0.15–0.20 and, consequently, the multiphase pumping head ($H_{Ph}$) loses 80% of its liquid single-phase value( $H_L$), which leads to a multiphase efficiency E=0.2. The main cause is due to the separation of the phases: the liquid particles are centrifuged in the impeller, forming a thin liquid film on the external wall. This liquid film moves along the external wall of the impeller and of the stator, which leads to a fall in the kinetic energy of the multiphase effluent and to a degradation of the multiphase pumping head ($H_{Ph}$).

On the basis of this experiment, the petroleum and gas industry has studied a helical-axial flow impeller wherein the centrifugation effect is limited and, consequently, part of the liquid phase is kept dispersed in the gas, thus leading to a higher multiphase efficiency E=0.5 to 0.8, for an inlet pressure above 10 bars. For low gas ratios, combination of a helical-axial flow staged pump followed by a centrifugal pump has been proposed for pumping at the bottom of oil wells, in FR-A-2,748,533.

However, this result is relative because of the fact that the liquid pumping head ($H_L$) of the helical-axial flow impeller is low in relation to that of semiaxial-flow pumps, so that, globally, the multiphase pumping head ($H_{Ph}$) obtained by the two systems is comparable.

Furthermore, at low pressures (2–3 bars), the multiphase efficiency (E) of existing industrial impellers (semiaxial-flow pumps as well as helical-axial flow pumps) becomes very low (E being then about 0.1), which is disadvantageous for practical use.

SUMMARY OF THE INVENTION

The aim of the present invention is to propose a pump comprising at least one multiphase pumping cell capable of providing an interesting liquid pumping head ($H_L$), (which is currently the case for semiaxial-flow pumps, but not for helical-axial flow pumps) while having a good multiphase efficiency (E) (which is currently the case for helical-axial flow pumps, but not for semiaxial-flow pumps).

The present inventor therefore has discovered that, contrary to the idea which naturally occurs, according to which the phases should not be separated, and which is applied in the case of helical-axial flow pumps, at least partial separation of the phases in the impeller could be accepted and that one could take advantage of the transmission of the high kinetic energy of the liquid film to the effluent to be pumped, provided that dynamic means, and not static means, ensuring the mechanisms of homogenization of the phases and of their energy levels, then of pressure recovery and finally gas compression are provided. Most of these means are not implemented in the existing systems once they have transmitted the kinetic energy to the (more or less separated) phases, because the stators used in existing pumps are not suited to fulfil these functions. In particular, these conventional stators do not ensure the process of energy exchange between the phases and are limited to transfer of the flows to the outlet in the configuration of more or less separated phases, which leads to a great degradation of the multiphase efficiency (E).

The object of the present invention is thus first a cell for pumping a multiphase effluent, characterized in that it comprises two rotary parts, the first part consisting of a hydraulic wheel designed for transmitting kinetic energy to each phase of the multiphase effluent entering the cell, and the second part, following the first, consisting of an energy converting device designed for homogenizing the phases, transferring kinetic energy between the phases, entraining the lightest phase, converting kinetic energy into pressure and compressing the homogeneous effluent before it leaves said cell, all of said rotary parts being mounted on a common shaft axially arranged inside a fixed housing comprising an inlet and an outlet for the multiphase effluent.

The two components of the pumping cell according to the present invention are thus rotary, unlike existing industrial systems, the second component fulfilling, in a new and original way, in combination, several rebalancing functions in relation to the effects due to a partial separation of the phases, also allowed, in a new and original way, by the first component.

The hydraulic wheel forming the first rotary part of a pumping cell according to the present invention generally consists of a boss mounted on the axial shaft and carrying blades exhibiting a hydrodynamic profile to allow transmission of kinetic energy to the multiphase effluent, the blades forming, between the housing and the boss, channels whose length is sufficiently great to provide the kinetic energy level required for carrying the multiphase effluent.

The energy converting device forming the second rotary part of a pumping cell according to the invention consists, according to a particularly interesting embodiment, of at least one continuous or discontinuous helical wheel carried by a boss mounted on the axial shaft and which rotates in an energy homogenization and transfer chamber delimited by the housing and having a section orthonormal to the axis substantially larger than the sum of the sections orthonormal to the axis of the channels of the hydraulic wheel, the extended length of said helical wheel or of said helical wheels being sufficiantly great for the kinetic energy homogenization and transfer efficiency required for pressure recovery.

The energy converting device must first homogenize the phases. In the case of a gas-liquid mixture, this means that the liquid particles must entrain the gas, transmitting kinetic energy thereto. Mixing must therefore be long enough, a function that is fulfilled by the helical wheel(s), a dynamic mixer, capable of homogenizing the phases. Once the mixture homogenized, conversion of kinetic energy into pressure is obtained by means of a significant speed decrease due to the increase in the section of the chamber. Finally, the chamber-helical wheel(s) system is such that it simultaneously provides compression of the homogeneous effluent, mainly of its gas phase, before it leaves the cell, and this effect can be intensified if the angle of the helical wheel(s) is varied by increasing it in the direction of the cell outlet.

All these functions essential for energy recovery of the pressure in the multiphase effluent are specific to the present invention. The conventional stator of existing industrial systems does not provide the exchange process between the phases and it is limited to transfer of the flows to the outlet in the configuration of more or less separated phases, which leads to a degradation of multiphase efficiency E.

After thus describing the preferred main characteristics of the two rotary parts forming the pumping cell according to the invention, non-limitative particular embodiments of the geometry of these two parts are described hereafter:

- The ratio of the section orthonormal to the axis of the energy homogenization and transfer chamber of the energy converting device to the sum of the sections orthonormal to the axis of the channels of the hydraulic wheel is notably 3 to 10.
- The or each continuous or discontinuous helical wheel of the energy converting device extends over an angle of at least 270° and advantageously makes a complete turn.
- Two or three continuous or discontinuous helical wheels can also be provided for the energy converting device; they are then advantageously and evenly axially shifted and exhibit an angular displacement in relation to one another of 180° and 120° respectively.
- The angle of inclination of a or of each helical wheel of the energy converting device in relation to a plane perpendicular to the shaft in the direction of the pumping cell outlet is advantageously of the order of 10°, and it can increase at the outlet where it can be 20°.
- The hydraulic wheel can have a constant or variable diameter, the ratio of the outside diameter (Ds) of said wheel at the outlet to its outside diameter at the inlet (De) being notably 1 to 3. Unlike well-known helical-axial flow impellers, the outside diameter of the hydraulic wheel of the pumping cell according to the present invention can increase in the direction of the outlet in order to intensify the kinetic energy transfer to the phases.

Furthermore, in relation to well-known semiaxial-flow impellers, it can be noted that the length of the channels of the hydraulic wheel of the cell according to the present invention is sufficient for energy phenomena to be stabilized, which means that partial separation of the phases is accepted. Under such conditions, in the case of a gas-liquid effluent, the liquid particles whose kinetic energy is highly concentrate in the vicinity of the external wall and, at the outlet of the hydraulic wheel, inside a channel, there is gas, followed by a gas-liquid mixture and by a liquid layer outside.

The channels are advantageously identical, their number can for example range between 4 and 10. Their length is notably, $$k \times \frac{De + Ds}{2},$$

k ranging between 0.5 and 1.5.

- A static or dynamic flow diffuser device is preferably provided to ensure good distribution and continuity of the flow at the outlet of the hydraulic wheel of a pumping cell over the total section of the energy homogenization and transfer chamber of the associated energy converting device; such a device can advantageously consist of a grate with hydrodynamic profiles carried by the housing and mounted in said chamber, between the inside of the housing and the helical wheel(s).

The present invention also relates to a pump comprising a multiphase pumping cell as defined above, or several of these cells mounted in series, the shaft carrying the rotary parts being common to all the cells. The number of these pumping cells is selected to provide the multiphase pumping head required for the application considered.

It can also be noted that the pump according to the invention can readily fit already existing mechanical pumping structures, the rotary parts, respectively the specific impeller and the rotary energy converting device, of a or of each cell according to the invention respectively replacing the impeller and the static diffuser of an existing cell, the existing structure of the housing elements, of the shaft and of the bearings being maintained.

BRIEF DESCRIPTION OF THE DRAWINGS

In order to better illustrate the object of the present invention, two particular embodiments are described hereafter by way of non limitative example, with reference to the accompanying drawings.

In these drawings.

DETAILED DESCRIPTION

Figure 1:
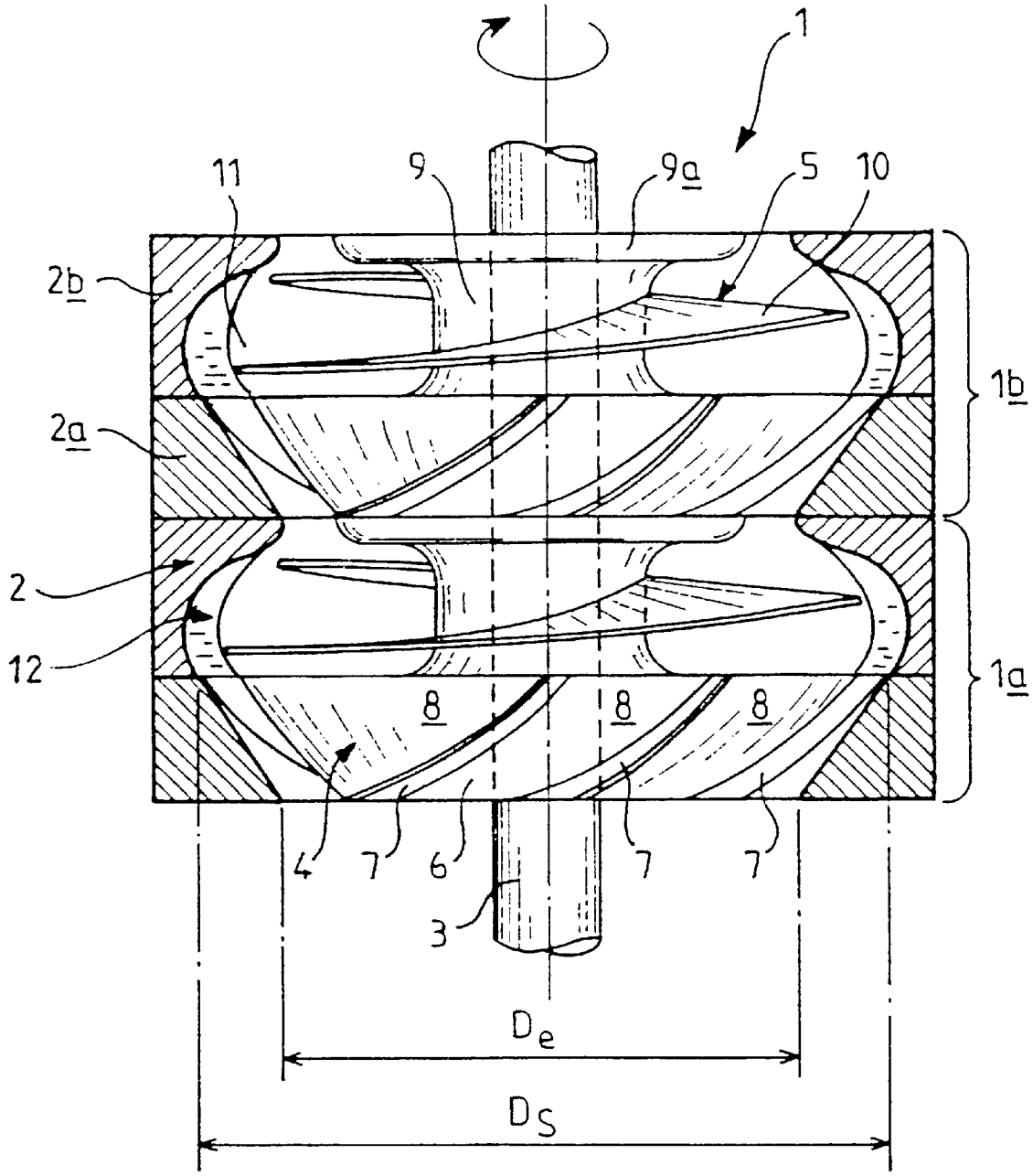
FIGS. 1 and 2 are diagrammatic views, partly axial sectional view and partly front view, of two pumping cells, mounted in series, of a pump respectively in accordance with a first and with a second embodiment of the invention.

FIG. 1 shows the two identical pumping cells 1*a* and 1*b*, mounted in series, of a pump 1 according to the invention.

Cells 1*a* and 1*b* are delimited by a housing 2 of general cylindrical shape, along whose axis is arranged a rotating shaft 3 driven by a motor. In the example shown, the multiphase effluent to be pumped first enters cell 1*a* and it flows out through cell 1*b*. The extensions of housing 2 for delimiting the inflow of the multiphase effluent in pump 1 and its outflow are not shown, neither are the bearings supporting rotating shaft 3.

The part of housing 2 associated with a cell consists of two elements of general annular shape, of equal outside diameter, superposed in diametral planes: an element 2*a*, at the cell inlet, with a truncated-cone-shaped inner wall opening out towards the inside, and an element 2*b*, at the cell outlet, having a concave wall directly joining up with the neighbouring elements 2*a*. Part 2*b* of the housing comprises a flow diffuser device consisting of an assembly of hydrodynamic profiles 12 fastened to the inside of the housing.

Inside each cell 1*a* and 1*b*, from the inlet to the outlet thereof, shaft 3 successively carries a hydraulic wheel 4 and an energy converting device 5.

The hydraulic wheel 4 of a cell is arranged in the space delimited by the associated housing element 2*a* and it rotates with a very slight play in said space. It consists of a boss 6, secured in rotation to shaft 3 and carrying six blades 7 evenly distributed on the periphery thereof. Boss 6 has a truncated-cone-shaped outer wall that opens out towards the inside of the associated cell, with substantially the same inclination as the truncated-cone-shaped inner wall of element 2*a* in relation to housing 2, and it comprises end walls at the inlet and at the outlet of said element 2*a*. In the example shown, each blade 7 extends, in projection in a diametral plane, over more than 60°, and it is inclined at an angle ranging between 15 (at the inlet) and 35° (at the outlet) in the direction of the outlet in relation to the mid-plane of boss 6. The Ds/De ratio of hydraulic wheel 4 (Ds and De as defined above) is here 1.4.

Six peripheral channels 8 allowing inflow of the multiphase effluent in a cell are thus defined, channels whose length is such that a high kinetic energy can be communicated to said effluent by said wheel 4.

Energy converting device 5 consists of a boss 9 of smaller diameter than boss 6 of wheel 4, which is secured in rotation to shaft 3 and carries a helical wheel 10 inclined in the direction of the outlet at an angle of the order of 10° in relation to the diametral plane and extending over an angle of the order of 270°. Boss 9 is connected to boss 6 of hydraulic wheel 4 of the next cell (or ends, in the case of outlet cell 1*b*) by a cupped part 9*a*. Rotating helical wheel 10 thus rotates in a chamber 11 delimited by part 2*b* of housing 2, provided with hydrodynamic diffusers 12, and boss 9–9*a*, and converts kinetic energy as defined above up to the cell outlet. Chamber 11 thus has a section that is orthonormal to shaft 3 which, from the inlet, increases in relation to the outlet section of wheel 4, then decreases in the vicinity of the outlet to form, with part 9*a* of boss 9, an annular outlet directly supplying the inlet of channels 8 in the case of cell 1*a*. Helical wheel 10 is designed for rotating with a play in a volume corresponding to that of chamber 11. Considering the energy homogenizing function of the helical wheel, it is not necessary for this play to be as limited as that of blades 7.

In this example, the ratio of the section of chamber 11 orthonormal to the inlet thereof to the sum of the sections of channels 8 is of the order of 6.

Figure 2:
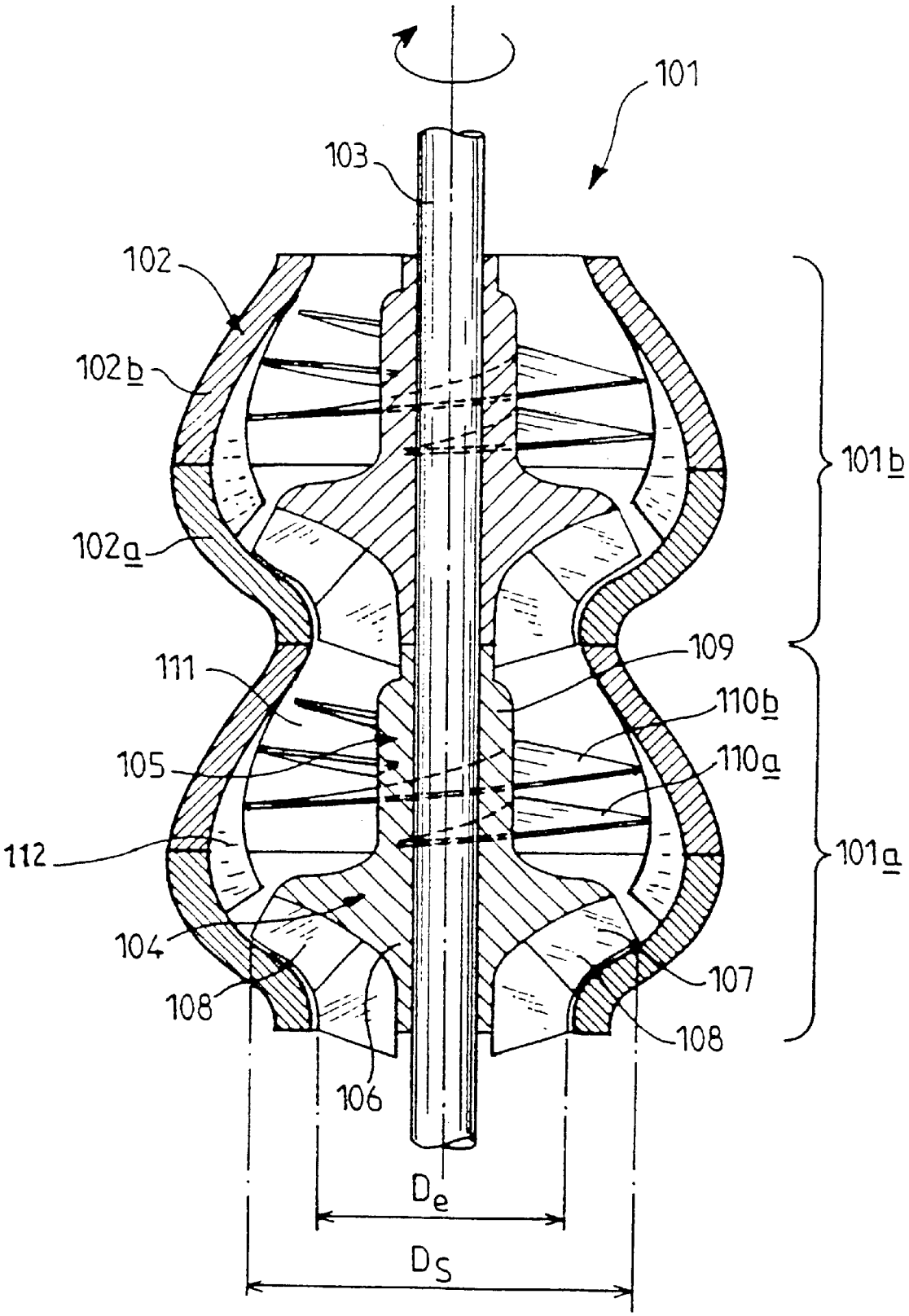

Preliminary tests carried out with the pump of FIG. 1 confirmed the significant improvement in the multiphase performances, including at low pressure at the inlet. FIG. 2 shows a pump 101 made according to a variant of pump 1. The elements of pump 101 are designated by reference numbers that are greater by 100 than the similar elements of pump 1. Only the modifications made in relation to pump 1 are described hereafter.

Pump 101 comprises two identical pumping cells 101*a*, 101*b*, the part of housing 102 associated with cell 101 a consisting of a first element 102*a* comprising a cylindrical inlet that opens out and is connected along a diametral plane to part 102*b* which progressively narrows and is connected, along a diametral plane, to part 102*a* of cell 101*b*. The end part 102*b* of the latter delimits the outlet for the multiphase effluent. Part 102*b* of the housing, provided with hydrodynamic diffusers 112, forms the outer casing of homogenization chamber 111.

Hydraulic wheel 104 is here a semi-axial wheel and energy converting device 105 comprises here two rotary helical wheels 110*a* and 110*b* which are axially shifted by a half-pitch, with an angular displacement of 180°.

The embodiments described above are of course not limitative and they can be subjected to any desirable modification without departing from the scope of the invention.

What is claimed is:

1. A cell for pumping a multiphase effluent, comprising:

a fixed housing including an inlet and an outlet for the multiphase effluent, and a hydraulic wheel and an energy converting device successively mounted on a common shaft axially arranged inside the fixed housing;

the hydraulic wheel including a first boss mounted on the common shaft and carrying blades, the blades forming, between the fixed housing and the first boss, channels, and the energy converting device including at least one helical wheel carried by a second boss which is mounted on the common shaft and which rotates in an energy homogenization and transfer chamber delimited by the fixed housing, a ratio of a section orthonormal to the axis of the energy homogenization and transfer chamber to a sum of sections orthonormal to the axis of the channels of the hydraulic wheel being 3 to 10.

2. A pumping cell according claim 1, wherein the at least one helical wheel of the energy converting device extends over an angle of at least 270°.

3. A pumping cell according to claim 1, wherein two helical wheels are provided for the energy converting device, the two helical wheels being evenly axially shifted and exhibiting an angular displacement in relation to one another of 180°.

4. A pumping cell according to claim 1, wherein three helical wheels are provided for the energy converting device, the three helical wheels being evenly axially shifted and exhibiting an angular displacement in relation to one another of 120°.

5. A pumping cell according to claim 1, wherein an angle of inclination of the at least one helical wheel of the energy converting device in relation to a plane perpendicular to the common shaft in direction of the outlet of the fixed housing is of the order of 10°, and increases in the direction of the outlet up to 20°.

6. A pumping cell according to claim 1, wherein a ratio of an outside diameter Ds of said hydraulic wheel at the outlet to the outside diameter De of the hydraulic wheel at the inlet is between 1 to 3.

7. A pumping cell according to claim 1, wherein the channels of the hydraulic wheel are identical, and between 4 and 10 channels are provided.

8. A pumping cell according to claim 6, wherein a length of the channels of the hydraulic wheel is $$k \times \frac{De + Ds}{2},$$

where k ranges between 0.5 and 1.5.

9. A pumping cell according to claim 1, further comprising a flow diffuser device providing distribution and continuity of the flow at the outlet of hydraulic wheel over the total section of energy homogenization and transfer chamber of the associated energy converting device.

10. A pumping cell according to claim 9, wherein the flow diffuser device comprises a grate with hydrodynamic profiles, carried by the fixed housing and mounted in the energy homogenization and transfer chamber between the inside of the fixed housing and the at least one helical wheel.

11. A method for using the pumping cell according to claim 1, comprising pumping an effluent with the pumping cell, the effluent comprising a mixture of at least two phases selected from (a) a liquid phase including at least one liquid, (b) a gas phase including at least one free gas, and (c) a solid phase including particles of at least one solid suspended in at least one of the liquid phase and the gas phase.

12. A pump comprising at least one cell for pumping a multiphase effluent, the at least one cell comprising:

a fixed housing including an inlet and an outlet for the multiphase effluent, and a hydraulic wheel and an energy converting device successively mounted on a common shaft axially arranged inside the fixed housing;

the hydraulic wheel including a first boss mounted on the common shaft and carrying blades, the blades forming, between the fixed housing and the first boss, channels, and the energy converting device including at least one helical wheel carried by a second boss which is mounted on the common shaft and which rotates in an energy homogenization and transfer chamber delimited by the fixed housing, a ratio of a section orthonormal to the axis of the energy homogenization and transfer chamber to a sum of sections orthonormal to the axis of the channels of the hydraulic wheel being 3 to 10.

13. A pump according to claim 12, comprising several of the cells mounted in series.

* * * * *